United States Patent [19]

Lindeberg et al.

[11] Patent Number: 4,737,126

[45] Date of Patent: Apr. 12, 1988

[54] PADDLE

[76] Inventors: Stefan Lindeberg, Svanvägen 29, 611 62 Nyköping; Leif Håkansson, Fornuddsvägen 28, 135 52 Tyresö, both of Sweden

[21] Appl. No.: 746,674

[22] Filed: Jun. 20, 1985

[30] Foreign Application Priority Data

Jun. 27, 1984 [SE] Sweden ..... 8403439

[51] Int. Cl.[4] ..... B63H 16/04

[52] U.S. Cl. ..... 440/101; 416/70 R

[58] Field of Search ..... 440/101; 416/69, 70 R, 416/74; 114/274

[56] References Cited

U.S. PATENT DOCUMENTS

| | | | |
|---|---|---|---|
| 4,050,397 | 9/1977 | Vanderleest | 114/274 |
| 4,147,469 | 4/1979 | Sherborne | 416/74 X |

FOREIGN PATENT DOCUMENTS

| | | | |
|---|---|---|---|
| 346420 | 12/1921 | Fed. Rep. of Germany | 416/74 |
| 401104 | 8/1941 | Italy | 416/70 |
| 749730 | 7/1980 | U.S.S.R. | 440/101 |
| 796079 | 1/1981 | U.S.S.R. | 440/101 |

*Primary Examiner*—Sherman D. Basinger

*Attorney, Agent, or Firm*—Nies, Webner, Kurz & Bergert

[57] ABSTRACT

A blade (9) for a paddle intended for paddling a canoe or corresponding water-craft, which paddle comprises a paddle shaft and a blade arranged on at least one end of the paddle shaft and intended to be inserted fully or partially into the water with the main-extension plane of the blade located substantially transversally to the longitudinal axis of the canoe or like watercraft during a so-called paddle stroke for forward propulsion of the canoe, where the one side (12″) of the blade, which is intended to face forwards relative to the intended direction of travel, the front face (12″) of the blade, is curved. The cross-sectional shape of the blade (9) throughout substantially the whole of the blade, substantially perpendicular to the longitudinal axis of the paddle shaft, had a configuration such that the blade, in addition to normally occurring pressure forces, also utilizes suction forces resulting from the passage of the water over the surface of the blade upon lateral displacement of the blade (9) through the water substantially in the direction of the main-extension plane, with the plane forming a given angle with the direction of paddle displacement and substantially transversally to the longitudinal axis of the paddle shaft, and for avoiding the formation of turbulence or eddy currents around the blade, where the blade (9) is formed so that the forces counter-act rearward displacement of the blade (9) through the water during a paddle stroke and where the cross-sectional profile of the blade (9) is asymmetric, substantially similar to the cross-sectional profile of the wing or the like of an aeroplane, where a first edge part (10) of the cross-sectional profile intended during the aforementioned lateral displacement to form the leading edge part (10) remote from the canoe herewith corresponds to the leading edge of a wing, and where the cross-sectional profile of both sides (12′, 12″) of the blade (9) between the two edge parts (10,11) of the cross-sectional profile, are completely devoid of outwardly projecting turbulence-creating portions, such as ridges and the like in order to avoid turbulent flow.

8 Claims, 1 Drawing Sheet

PADDLE

Figure 1:
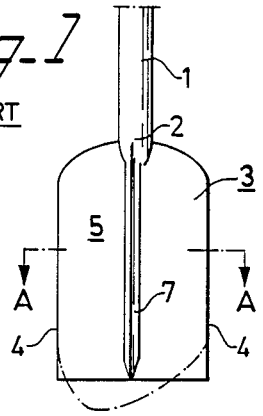
Fig. 1 PRIOR ART

The present invention relates to a paddle for canoes and corresponding watercraft, comprising a paddle loom, (the shaft), and a blade located on at least one end thereof, said blade being intended to be totally or partially inserted into the water during a so-called stroke for forward propulsion of the canoe or corresponding watercraft.

The action of known paddles is based exclusively on the resistance offered by the water against movement of a blade therethrough in a direction which forms a substantial angle with the main extension-plane of the paddle, such as a direction substantially at right angles to said plane. The water is used in this way as a support, reaction surface, in propulsion. Eddy currents, turbulence, are created around the blade, however, causing the blade to be displaced in the water in the direction of the force applied, i.e. rearwardly of the direction in which the canoe is moving, which naturally results in loss of power. This paddle displacement is normally in the region of 5–10 cms and the extent of said displacement depends upon the adroitness of the person wielding the paddle. The blade of a conventional paddle is slightly curved and tapers towards the edges thereof and presents a central, stabilizing ridge in the direction of the shaft axis.

An essential circumstance in the present context is that the act of paddling has developed over recent years. Instead of attempting to place the paddle as close to the canoe as possible, as was previously the case, and keep a straight paddle while preventing lateral paddle movements, using to a large extent the arm muscles herefor, many present day competition canoists have transferred to a technique in which the powerful muscle groups of the back are used during increased twisting-/rotation of the trunk and less bending of the arms at the elbow, therewith releaving the strain on the arms. This new technique results in a greater pulling force and causes the paddle to move further away from the canoe in the water. When seen in relation to the canoe, the paddle is driven in a rearward and outward path. When the paddle moves rearwardly, in relation to the water, to only a very slight extent, the paddle will at the same time move in a lateral path, relative to the water, substantially straight out from the canoe.

The present invention relates to a blade which is constructed primarily for this new paddling technique and which is more effective than previously known blades. Thus, when using a blade according to the invention the blade is displaced rearwardly through the water during a paddle stroke to a smaller extent, and power losses resulting from the formation of eddy currents around the blade are greatly reduced.

Accordingly, the invention relates to a blade for a paddle intended for paddling a canoe or corresponding water-craft, said paddle comprising a paddle shaft, and a blade arranged on at least one end of the paddle shaft and being intended to be inserted fully or partially into the water with the main-extension plane thereof located substantially transversally to the longitudinal axis of the canoe or like watercraft during a so-called paddle stroke for forward propulsion of the canoe, where the one side of the blade, which is intended to face forwards relative to the intended direction of movement, the front face of the blade, is curved.

The blade according to the invention is particularly characterized in that the cross-sectional shape of the blade, throughout substantially the whole of the blade, substantially perpendicular to the longitudinal axis of the paddle shaft, has a configuration such that the blade, in addition to normally occurring pressure forces, also utilizes suction forces resulting from the passage of the water over the surface of the blade upon lateral displacement of the blade through the water substantially in the direction of said main-extension plane, with said plane forming a given angle with the direction of paddle displacement and substantially transversally to the longitudinal axis of the paddle shaft, and in a direction away from the canoe and for avoiding the formation of turbulence or eddy currents around the blade, where the blade is formed so that said forces counter-act rearward displacement of the blade through the water during a paddle stroke and where the cross-sectional profile of the blade is asymmetric, substantially similar to the cross-sectional profile of the wing or the like of an aeroplane, e.g. an aerofoil wing section, where a first edge part of the cross-sectional profile intended during said lateral displacement to form the leading edge part remote from the canoe, corresponds herewith to the leading edge of said wing, and where the cross-sectional profile of both sides of the blade between the two edge parts of the crosssectional profile, are preferably completely devoid of outwardly projecting turbulence-creating portions, such as ridges and the like, in order to avoid turbulent flow.

Figure 3:
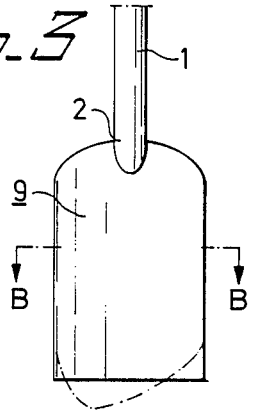
Figure 2:
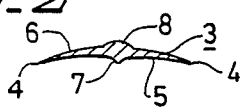
Fig. 2 PRIOR ART
Figure 4:
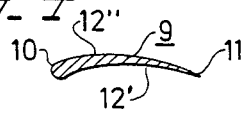
Figure 5:
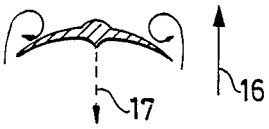
Fig. 5 PRIOR ART

An exemplary embodiment of the invention will now be described in more detail with reference to the accompanying drawing, in which FIG. 1 illustrates schematically the blade and part of the shaft of a paddle of known kind, the blade being shown at right angles to the plane of its main extension, and in the direction of travel during a forward propulsion stroke, FIG. 2 is a sectional view taken on the line A—A in FIG. 1, FIG. 3 illustrates schematically a blade according to the invention and a part of the paddle shaft in a manner similar to FIG. 1, FIG. 4 is a sectional view taken on the line B—B in FIG. 3, FIG. 5 illustrates schematically the formation of eddy currents, turbulence, around the blade of a known paddle when the blade is displaced substantially at right angles to the plane of its main extension and rearwardly in relation to the intended direction of travel.

Figure 6:
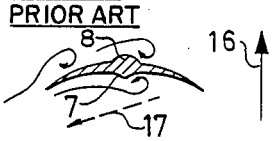
Fig. 6 PRIOR ART
Figure 7:
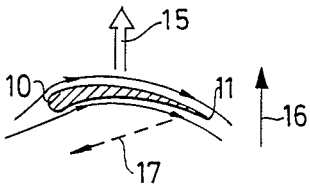
Figure 8:
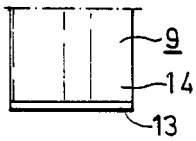
Figure 9:
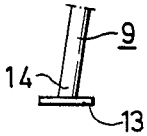
Figure 10:
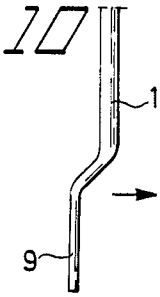

FIG. 6 illustrates schematically the formation of eddy currents, turbulence, around a blade according to FIG. 5 when the blade is displaced laterally and also rearwardly, FIG. 7 illustrates schematically the flow along the surface of a blade according to the invention, when the blade is displaced rearwardly and laterally, FIG. 8 is a schematic view of a part of a blade which includes an end plate, in which the blade is seen at right angles to the plane of its main extension, FIG. 9 illustrates the blade shown in FIG. 8 when seen from the side in FIG. 8, and FIG. 10 illustrates schematically a paddle in which the centre of gravity of the blade cross-section is pronouncedly offset in relation to the longitudinal axis of the paddle shaft.

In FIG. 1 the reference 1 identifies a paddle shaft, having a known blade 3 located at one end 2 thereof.

The blade 3 has a substantially symmetrical cross-section around a centre line and tapers towards its side edges 4. The blade also has a ridge 7,8 extending on a respective side 5,6 thereof in the direction of the longitudinal axis of the paddle loom 1, and is curved and therewith rearwardly concave as seen in relation to the intended paddling direction. When seen in relation to its main-extension plane, the blade may be symmetrical about the longitudinal axis of the paddle shaft, as shown in full ines in FIG. 1, or asymmetrical, as shown in broken lines.

In the case of a paddle provided with a blade 9, FIGS. 3,4 and 7 according to the invention the cross-sectional profile of substantially the whole blade substantilaly perpendicular to the longitudinal axis of the paddle shaft 1 has an asymmetric configuration substantially similar to the cross-sectional profile of the wing of an aeroplane, such a configuration being that preferred. In this case a first edge part 10 of the cross-section and of the blade 9 corresponding to the leading edge of an aircraft's wing and intended to constitute the leading edge part upon lateral displacement of the blade in the intended manner, is preferably gently rounded and the second edge part 11 preferably tapers gradually, preferably in an egg-shape configuration. In addition, in order to avoid the formation of eddy currents or turbulence, the cross-sectional profile of the two sides 12', 12" of the blade between said edge parts 10, 11 are preferably devoid of outwardly projecting turbulence-creating promonatories, such as ridges or the like.

According to the illustrated embodiment, the side 12' of the blade 9 intended to face rearwardly in relation to the intended direction of travel has a pronounced cupped shape.

FIGS. 8 and 9 illustrate an embodiment in which an end plate 13 or the like is provided at the blade tip 14 remote from the paddle shaft 1, this end plate being intended to prevent water flowing past at the tip end of the blade.

FIG. 10 illustrates an embodiment in which for reasons of stability the blade is constructed so that the centre of gravity of the blade cross-section is located markedly behind the longitudinal axis of the paddle shaft relative to the intended direction of travel.

The functional mode of the blade, and therewith the paddle, according to the invention will be evident to a large extent from the aforegoing.

Thus, the blade is given a cross-sectional profile with which there are utilized pressure/suction forces occurring when the blade is displaced laterally through the water substantially in the direction of said mainextension plane, with this plane forming a certain angle with the displacement direction and substantially transversally to the longitudinal axis of the paddle shaft 1, where the blade is formed so that said forces, marked with an arrow 15 in FIG. 7, shall counteract rearward displacement of the blade through the water during a paddle stroke, and so as to avoid power losses due to turbulence.

The flow around a blade is illustrated in FIGS. 5–7. As illustrated in FIG. 5, eddy currents, or turbulence, form at the edges of the blade during rearward movement thereof. In FIGS. 5–7 the intended movement direction is shown by arrows 16 and the canoe or corresponding watercraft is intended to be located on the same side of the blade as the arrows 16. The direction of blade displacement relative to the water is marked with broken arrows 17. Such rearward displacement and turbulence formation occurs to a certain extent both with the known blade and with the blade according to the invention. Upon displacement of a known blade, FIG. 6, even laterally, considerable eddy currents are formed, turbulence, both at the leading edge, seen in the direction of travel, and at the ridges 7,8, therewith greatly reducing efficiency. Upon displacement, as intended, of a blade according to the invention, even laterally, FIG. 7, a substantially laminar flow is obtained along the blade, thereby avoiding losses in efficiency.

As should be apparent from the above, a paddle according to the invention affords considerable advantages over known paddles. While utilizing the forces which may occur upon lateral displacement of the blade through the water, rearward displacement of the blade decreases during each paddle stroke. Efficiency-reducing turbulence is avoided to the greatest extent possible.

Scientific tests carried out while paddling with known paddles and paddles constructed according to the invention, while measuring lacticacid content, lactate content, of the blood of the canoist have shown that a higher degree of efficiency is clearly obtained when paddling with a paddle according to the invention. For example, the tests have shown that at the so-called OBLA-level where OBLA stands for "onset of blood lactate accumulation" and is normally set at 4.0 mmol/l, the performance achieved is much higher with a paddle according to the invention when measured in terms of the speed of forward propulsion.

The tests also showed that the speed in relation to the number of strokes per unit of time is also higher. Expressed in another way, it can be said that when using a paddle according to the invention, a canoe will cover a longer distance for each paddle stroke, and less work is required on the part of the canoist at a given forward propulsion speed.

The invention has been described in the aforegoing with reference to various embodiments thereof. It will be understood, however, that other embodiments are conceivable and that minor modifications can be made within the scope of the concept of the invention.

For example, among other things the curvature of the cross-sectional profile, the thickness thereof and the breadth between the edge parts 10, 11 can be varied. In this respect the blade profile may deviate quite essentially from the aerofoil section of an aircraft wing, while retaining the suction-force and pressure-force effect afforded by such an asymmetric cross-sectional shape. Thus, within the scope of a blade-form according to the invention, it is conceivable for the blade to exhibit a thickening at and in the close proximity of said first edge part, and that the cross-sectional profile when seen in a direction towards the second part thins rapidly, to retain a substantially uniform thickness substantially upto the second edge part, at which location the cross-sectional profile is preferably terminated with a point of given length. Also conceivable are other cross-sectional profiles which resemble more a filled sail, where a phenomenon similar to that experienced with the wing of an aeroplane occurs.

The blade may also be given a cross-sectional shape such that the force composed of said forces does not attack centrally,as seen in the transverse, breadth, direction of the blade.

Embodiments are also conceivable in which the paddle shaft is not centrally located, as in FIG. 3, when seen in the transverse, breadth, direction of the blade.

Embodiments are also conceivable in which the rearward side of the blade, corresponding to the under-surface of a wing, or main plane, is subtantially planar. The aforesaid first edge part may also be sharp, instead of gently rounded.

It will also be understood that the invention is not restricted to canoe paddles, but can also be applied in conjunction with oars.

Thus, the invention shall not be considered to be restricted to the aforedescribed embodiments, but that modification can be made within the scope of the following claims.

We claim:

1. A blade for a paddle intended for paddling a canoe or corresponding watercraft, said paddle to be manually held, and operated solely by the user, said paddle comprising a paddle shaft, and a blade with two sides arranged on at least one end of the paddle shaft and with a main-extension plane intended to extend substantially transversally to the longitudinal axis of the canoe or like watercraft during a so-called paddle stroke for forward propulsion of the canoe, where at least one of the two blade sides the front face, has a convex curve, the improvement being characterized in that the cross-sectional shape of the blade (9) throughout substantially the whole of the blade, has a configuration such that the blade utilizes suction forces resulting from the passage of the water over the blade upon lateral displacement of the blade through the water substantially in the direction of said main extension plane, with said plane forming a given angle with the direction of paddle displacement, the profile of said cross-sectional shape of said blade (9) being asymmetric, substantially similar to the cross-sectional profile of an airfoil section of an airplane wing, said cross-sectional profile being asymmetric with respect to both a central plane substantially parallel with said main-extension plane and a central plane substantially perpendicular to said main-extension plane, said blade having a first edge part (10), a leading edge (10), corresponding to the leading edge of a wing and a second edge part (11), a trailing edge (11), corresponding to the trailing edge of a wing, the leading edge being the edge of the blade, which, during a paddle stroke is substantially vertical and turned from the watercraft thus being the edge being located at the greatest distance from the watercraft, the blade surface (12″) between the leading edge and the trailing edge, which is turned towards the front edge of the watercraft, having a convex curve, the cross-sectional profile of both sides (12′,12″) or faces of the blade (9) having a smooth contour between the two edge parts (10,11) and preferably being essentially completely devoid of outwardly projecting turbulence-creating portions, such as ridges and the like, the blade thereby being shaped so that said suction force shall counteract rearward displacement of the blade through the water during a paddle stroke, wherein the blade undergoes a lateral displacement away from the watercraft.

2. A blade according to claim 1, characterized in that, in cross-section, said first edge part (10) is gently rounded.

3. A blade according to claim 1, characterized, in that, in cross-section, the second edge part (11) tapers gradually.

4. A blade according to claim 1, characterized in that the other side (12′) of the blade (9), the rear face, has a pronounced concave curvature.

5. A blade according to claim 1, characterized in that an end-plate (13) or the like is provided at the end (14), of the blade (9) remote from the paddle shaft (1), said end-plate being intended to prevent the flowing of water off of said blade-end (14).

6. A blade according to claim 1, characterized in that the blade is offset from the longitudinal axis of the paddle shaft so that the effective longitudinal axis of the paddle shaft is behind the rear face of the blade and behind a line through the centers of gravity of the blade cross-sections.

7. A blade according to claim 1, characterized in that the blade (9) has a cross-section so formed that said suction force does not act on the longitudinal center of the blade.

8. A blade according to claim 1, characterized in that the longitudinal axis of the paddle shaft (1) is offset from the longitudinal axis of the blade in the transverse breadth direction of the blade.

* * * * *

UNITED STATES PATENT AND TRADEMARK OFFICE

CERTIFICATE OF CORRECTION

PATENT NO. : 4,737,126

DATED : April 12, 1988

INVENTOR(S) : STEFAN LINDEBERG et al.

It is certified that error appears in the above-identified patent and that said Letters Patent is hereby corrected as shown below:

On the Cover Sheet, in the ABSTRACT, Column 2, line 9, Change "had" to --has--.

IN THE SPECIFICATION:

Column 6, line 4, after "front" cancel "edge".

Signed and Sealed this

Second Day of August, 1988

*Attest:*

DONALD J. QUIGG

*Attesting Officer*

*Commissioner of Patents and Trademarks*